United States Patent [19]

Caurant et al.

[11] 4,365,959

[45] Dec. 28, 1982

[54] TANK-GUN LOADING SIMULATOR FOR TRAINING PURPOSES

[75] Inventors: Robert Caurant, Igny; Alain Leduc, Rambouillet, both of France

[73] Assignee: Thomson-CSF, Paris, France

[21] Appl. No.: 288,731

[22] Filed: Jul. 31, 1981

[30] Foreign Application Priority Data

Oct. 10, 1980 [FR] France ..... 80 21679

[51] Int. Cl.[3] ..... F41F 27/00

[52] U.S. Cl. ..... 434/24

[58] Field of Search ..... 434/24

[56] References Cited

U.S. PATENT DOCUMENTS

| | | | |
|---|---|---|---|
| 2,441,218 | 5/1948 | Bialek | 434/24 |
| 3,141,246 | 7/1964 | Boris | 434/24 |
| 4,194,304 | 3/1980 | Wolcott | 434/24 X |

*Primary Examiner*—William H. Grieb

*Attorney, Agent, or Firm*—Karl F. Ross

[57] ABSTRACT

This invention concerns a training simulator comprising a simulated gun, constructed mainly from machine-welded components and mechanisms, and which simulates a breech jacket, breech and breech wedge, and also comprising simulated ammunition, consisting of the assembly of a shell and a case, with means of connecting them together, and which are separated by applying pressure on the case in the same way as a detonator hammer.

When simulated firing occurs, the breech recoils on roller slides, under pressure from a hydraulic jack. A mechanism fixed to the breech raises the breech wedge by means of a first spring, and transmits to the breech-opening lever, through this spring and a second spring, a force of resistance equal to the force actually applied by the gun-loader to open the breech.

The purpose of this simulator is to train tank crews in the various procedures of a firing sequence.

5 Claims, 15 Drawing Figures

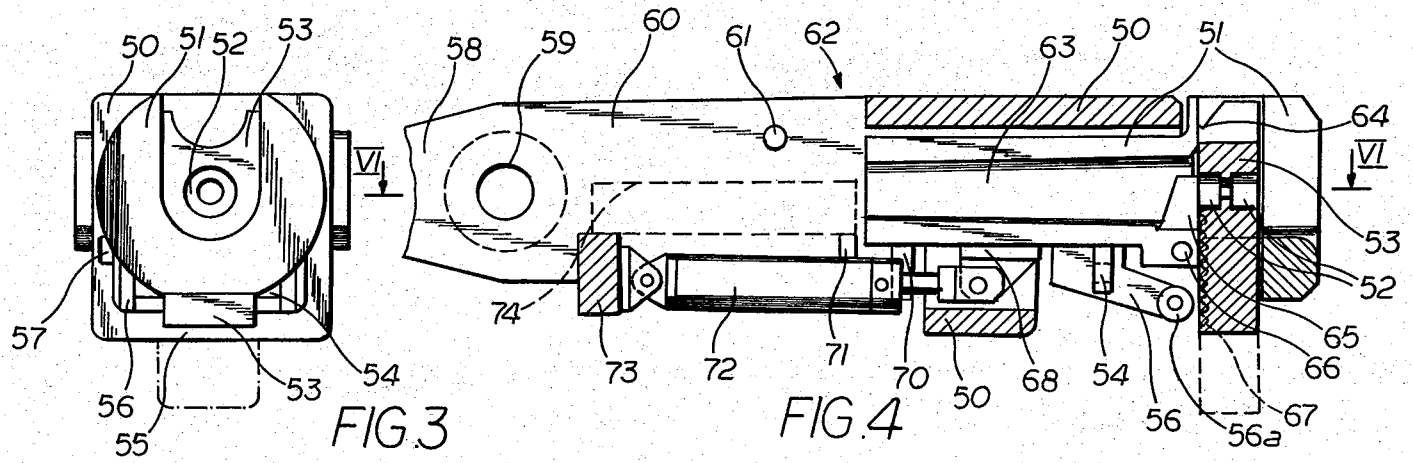
FIG. 4
FIG. 3
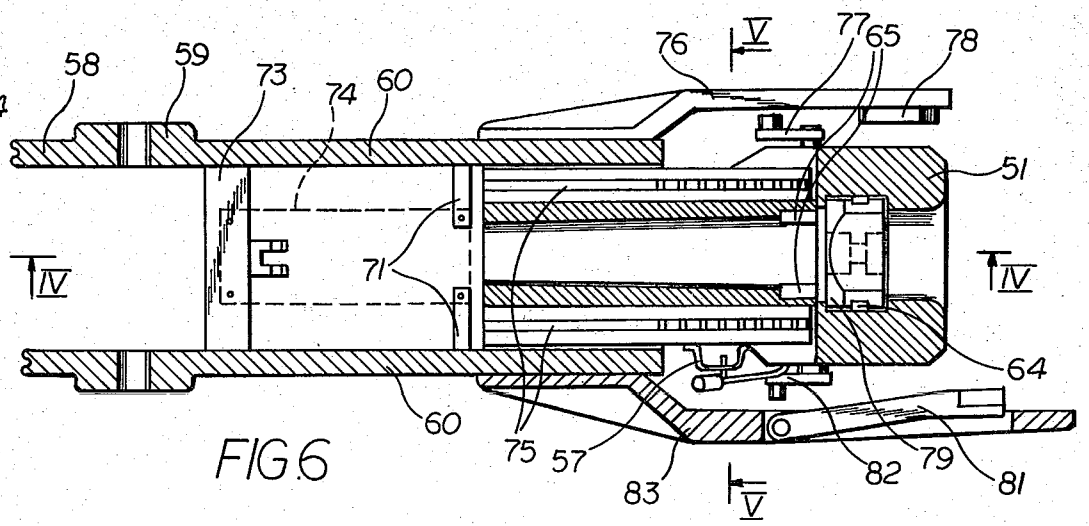
FIG. 6
FIG. 5

TANK-GUN LOADING SIMULATOR FOR TRAINING PURPOSES

BACKGROUND OF THE INVENTION

This invention concerns a tank-gun loading simulator used for training purposes.

For obvious reasons, many difficulties are involved in training on the ground, and in actual firing. These include consumption of expensive fuel, scarcity of training grounds, safety rules to be observed, time wasted in moving equipment to the area and preparing for firing, and the possibility of bad weather conditions. Although actual firing remains essential, the tendency at present is to confine it to final stages of training, using training simulators for basic instruction. Such simulators are intended to reproduce tank firing gear, less expensively, but realistically enough to allow trainees in loading and firing to familiarize themselves, not only with firing operations, but also with contingencies during firing. They offer comprehensive training, by means of reproducible exercises, under the supervision of a small number of instructors.

SUMMARY OF THE INVENTION

The purpose of the new training simulator described here is to enable trainee tank gunners to practise the different phases of a firing sequence.

This invention concerns a simulator which provides movement in elevation of a "simulated" gun, manual opening of the breech with lowering of the breech wedge, insertion by the trainee gun-loader of a "simulated" shell into the breech, and closure of the breech by automatic raising of the breech wedge, separation of the shell and its case, and transfer of the shell, out of sight of the trainees, to a storage position, recoil of the breech on firing, return of the breech, its opening, and ejection of the case; absence of breech recoil and ejection of the whole shell, found to be "defective" during simulation, by manual opening of the breech; manual closure of the breech by pushing extractors into the breech with an auxiliary wooden instrument, thereby releasing the breech wedge.

A characteristic feature of this new simulator is that the imitation ammunition consists of a shell and a case, connected together by a device which is released by applying pressure to the case in the same way as a detonator hammer.

Another characteristic feature of this new simulator is that recoil of the breech after firing is obtained by a hydraulic jack and two roller-mounted recoil slides.

BRIEF DESCRIPTION OF THE DRAWINGS

Other features of this new gun-loading simulator will appear in the following description of one possible embodiment, illustrated by the accompanying drawings:

FIG. 3, showing a head-on view of the gun,

FIGS. 4 and 6, showing two longitudinal sections, and

FIG. 5, showing a cross section.

DESCRIPTION OF A PREFERRED EMBODIMENT OF THE INVENTION

Figure 1:
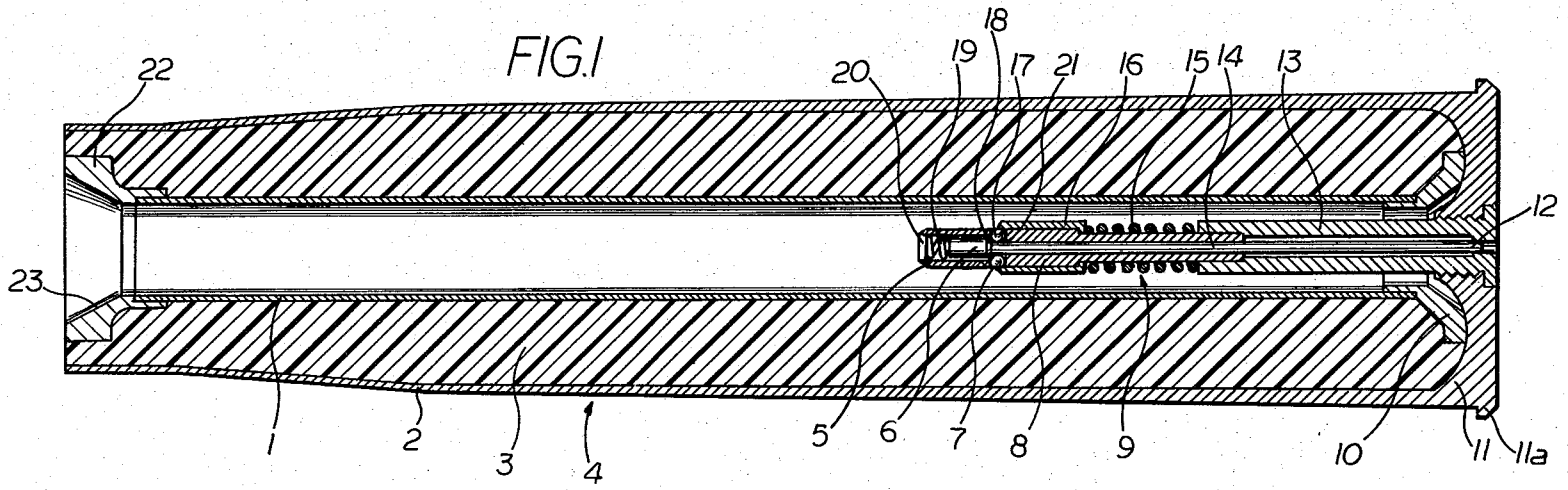
FIGS. 1 and 2, showing cross-sectional views of the ammunition used.
Figure 2:
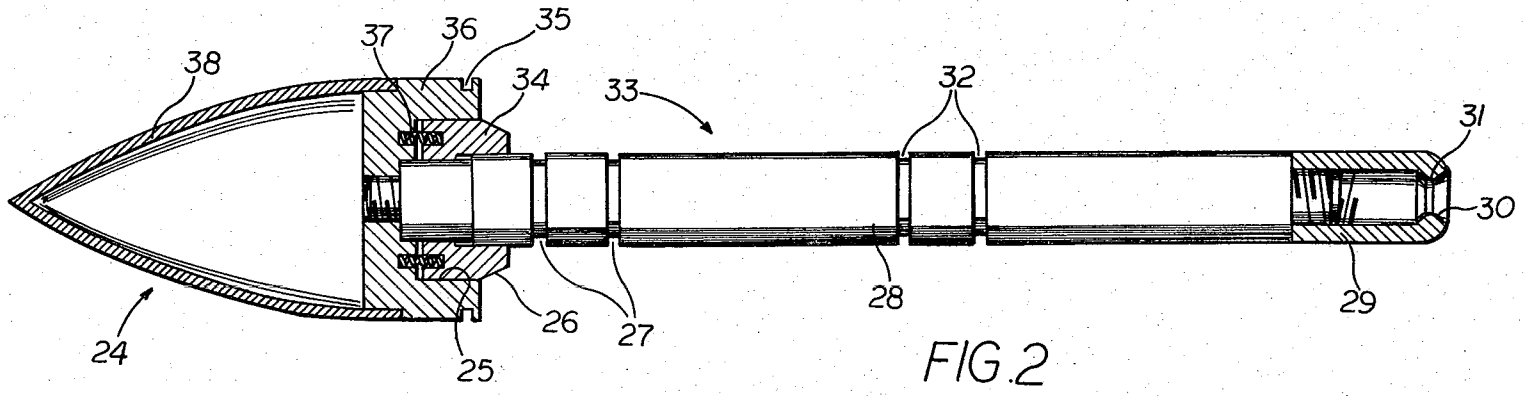

FIGS. 1 and 2 show the ammunition for this new simulator, comprising two parts, a case 4 and shell 33, which can be assembled manually, and which are separated by the simulator as soon as the ammunition is inserted into the breech, so that, after firing, when the breech returns, the case is ejected. The shell comprises a head 24 and a shank 28, which has a retaining end 29. The head comprises a barrel 36, the forward end of which is fitted with a conical head 38, possibly hollow, and a ring-shaped wedge 34, which fits into a cylindrical axial recess 25 in the rear end of the barrel. The conical head is force-fitted on to the cylindrical barrel 36, and the shank 28 is screwed in axially, passing through the ring 34. On the circumference of the barrel 36, near the rear end, there is a groove 35. The forward side of the ring 34, nearer the conical head 38, is slightly smaller in diameter, and the rear circumference contains a tapering centring surface 26. The ring slides on the shank 28, and inside the recess 25, without emerging completely, because the portion of the shank 28 on which it slides is smaller in diameter. It is pushed away from the end of the recess 25 by springs 37, which in FIG. 2 are partly compressed, the ring being partly inside the recess 25. The shank comprises one pair of gripping grooves 27 near the barrel 36, and another pair 32 mid-way along the shank. The exact shape, size and positions of these grooves depend on the conveyor system involved. The retaining end 29 is screwed to the free end of the shank 28. It is shaped approximately like a hollow cylindrical cap, with the same outside diameter as the shank 28, and with an inward-tapering opening 30 at the back end, the smallest diameter of this opening being less than the inside diameter of the whole cap, thus forming a neck 31.

The shell-case 4 comprises a casing 2, and an axial guiding system and locking device 9 inside the case. The casing 2 preferably consists of a real shell-case. The guiding system comprises an opening 22, a tube 1 and a supporting base 10, which holds it on the case axis; it is protected against any outside impacts or damage to the casing by a resilient moulded and polymerized plastic lining 3. The opening 22, which is level with the front end of the shell-case 4, is a ring force-fitted on to the front end of the tube 1, and comprises an inward-tapering centring surface 23. The tube 1 is also force-fitted into the supporting base 10, which is a flanged ring, with its flange screwed to the casing-base 11. The retaining end 29 and locking device 9 combine to connect the case and the shell. The locking device 9 comprises a support 13, lock-barrel 8, control-rod 14, locking balls 17, mask 16, and two springs 15 and 19. The tubular support 13 is screwed into the supporting base 10 and case-base at the point where the detonator would be in a real shell. The tubular lock-barrel 8 is force-fitted into the support 13. It comprises two portions with different inside diameters, the portion with the larger diameter being at the front, nearer the opening 22, and its length is approximately a quarter to a fifth of the total length of the barrel. The barrel also contains radial openings 7, positioned at regular intervals round the barrel circumference, on a single cross-section of the larger-diameter portion of the barrel at the transition point 21 between the two portions. The outside diameter of approximately the back half of the length of the barrel 8 is slightly reduced. The inside-diameter transition point 21 is located approximately half-way along the front half of the barrel. The mask 16 consists of a tube, the inside diameter of which is approximately the same as the outside diameter of the front part of the lock-barrel 8, and the back end of which comprises a rim extending inwards, the inside diameter of the opening formed by this rim being approximately the same as the outside diameter of the back portion of the lock-barrel 8. The spring 15 is positioned between the rim of the mask 16 and the support 13. When the mask 16 is in the forward position, its rim pressed against the shoulder on the lock-barrel formed by the difference in outside diameters, the front end of the mask covers the holes 7. The control rod 14 comprises a shank and a cylindrical head 6, which is larger in diameter than the rod shank, and which is connected to it by a tapered bearing surface 18.

The control rod shank slides inside the portion of the lock barrel with smaller inside diameter, while the rod head slides inside the portion with larger diameter, compressing the spring 19 held inside the barrel 8 by a plug 20 on the front end of the barrel. This front end comprises an outside tapering surface 5, with approximately the same dimensions as the conical opening 30 at the back of the end 29. When the shell and case are separated, pressure from the spring 15 makes the mask 16 slide along the lock-barrel 8, covering the openings 7. Pressure from the front spring 19 keeps the tapering surface 18 on the rod-head 16 pressed against the balls 17, which are blocked from outside by the mask 16.

The shell and case are assembled and locked together by inserting the shell shank manually into the case, until the tapered centring surfaces 26 and 23 are pressed against each other. The springs 37 keep the assembly tight, without any looseness. The shell shank 28 is guided by the tube 1 at the front end of the locking device. The conical opening 30 in the end 29 and the tapering surface 5 on the lock meet to ensure final centring, enabling the end to fit on to the end of the locking device. The end 29 pushes back the mask 16, compressing the spring 15. Once the neck 31 moves beyond the balls 17, which are no longer retained by the mask 16, they are pushed outside the circumference of the lock barrel 8 by the rod-head 16, as a result of pressure by the spring 19, so that they are blocked between the inside surface of the end 29 and the rod-head 6, thereby preventing the end 29 from being released, because of its neck 31.

The shell and case are unlocked by applying pressure to the back end 12 of the rod 14, which slides along, compressing the spring 19. Forward movement of the head 6 leaves space for the balls, which consequently no longer retain the end 29. The thrust is produced by an electromagnetic release device (not shown here), contained in the breech wedge and controlled by an electronic device.

Figure 7:
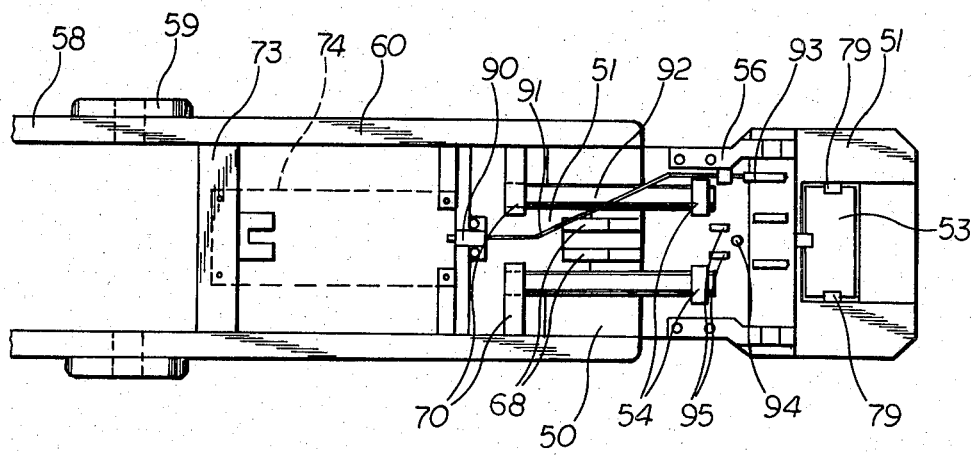
FIG. 7, showing a partial view of the underside of the gun.
Figures 10, 11:
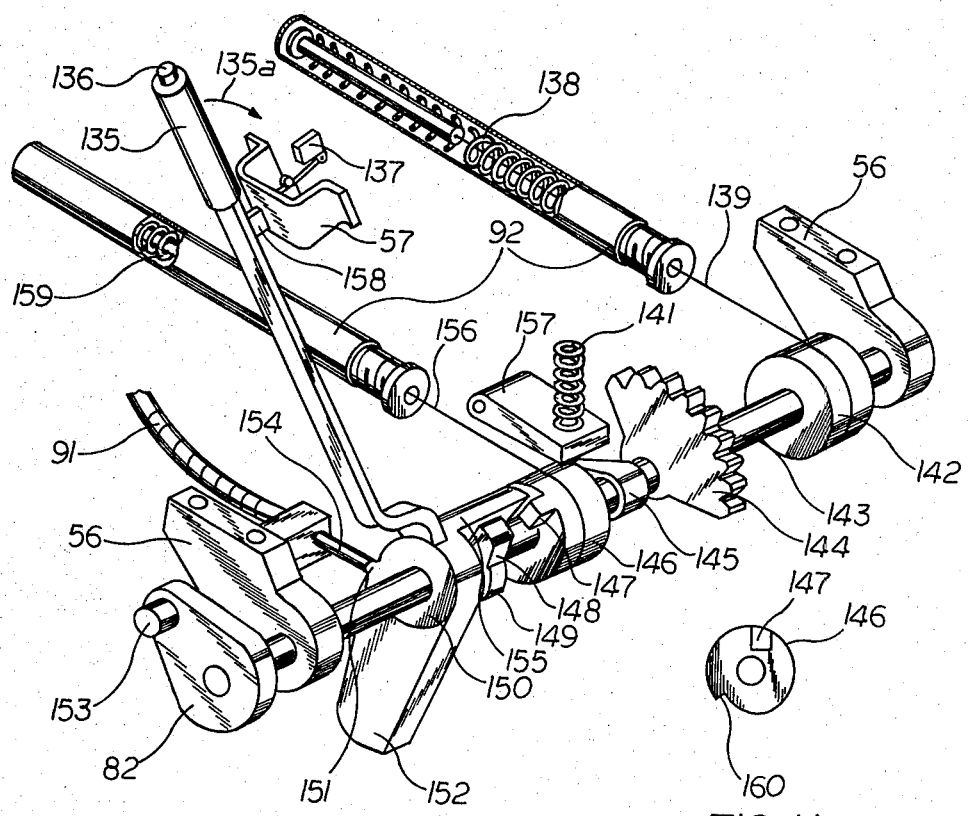
FIG. 10, showing an exploded view of the breech-wedge control mechanism of the gun illustrated in FIGS. 3 to 7, and FIG. 11, showing a cross-sectional view of a detail of this mechanism.

The gun used in this invention is formed mainly of machine-welded components, hydraulic jacks and two mechanisms. FIGS. 3 to 7 show the general layout of these various components which comprise a cradle 62, breech 51, breech wedge 53, breech chamber 63, and two mechanisms. The cradle 62, made from lightweight alloy, comprises a breech jacket 50 and two flanges 60, formed from a single piece. The top of the jacket 50 forms approximately a rectangular parallelipiped, with the longer axis parallel to the gun axis, and the underside, facing the breech 51, contains an axial groove, with a semi-circular cross-section, matching a groove in the top of the breech 51. The shorter bottom part of the jacket is hoop-shaped, and extends over a short distance towards the front end of the upper part. Level with this hoop, both parts of the jacket together form an approximately square outside section. The two flanges 60 are flat and parallel to each other, and form forward lateral extensions of the jacket 50. The cradle 62 pivots in elevation on bearings 59 in the flanges, under pressure from a hydraulic jack (not shown here), which presses against the base (not shown here) of the simulator, and on the end 58 (partly shown here) of one of the flanges. The breech 51, which has approximately the same form as a real breech, moves inside the jacket 50 on two side roller-slides 75, under pressure from a hydraulic jack 72, which presses on a strut connecting the two flanges 60, and at the other end on a brace 68 fixed to the breech 51. This jack is preferably positioned beneath the breech, so as not to be visible to the marksman. A breech wedge 53, forming approximately a rectangular parallelipiped, with the longer axis perpendicular to the gun axis, moves perpendicularly to the gun axis through the back part of the breech, along two vertical guides 79. Its front side comprises a rack 67, the top contains a catch 64, and the upper part contains a recess 52, parallel to the gun axis, and which contains a release mechanism with electromagnet and spring (not shown here). This recess may consist of two circular borings on the same axis, and of approximately the same size, drilled in opposite sides of the wedge 53; the bottoms of these holes are in close proximity to each other, and they are connected by another smaller hole, through the remaining thickness of the wedge. Each side of the back part of the breech chamber 63 contains a recess 65, inside which move extractors 166 (see FIG. 12), attached to the shaft 170 of an extractor mechanism, the secondary mechanism. This shaft 170 pivots on two bearings 66 fixed to the lower back part of the breech 51. The bottom of the breech carries two bearing supports 56, the axis of the bearings 56 being parallel to, below, and slightly further forward than the shaft 170. A breech-wedge control mechanism, the primary mechanism (see FIG. 10) pivots between these bearings 56. The lower side of the breech 51 also carries, on each side of its vertical symmetry plane, two supports 70, towards the front of the breech, and two other supports 54, situated approximately half-way along the breech. FIGS. 7 and 10 show spring boxes 92, forming part of the primary mechanism, and which fit between these supports.

Figure 8:
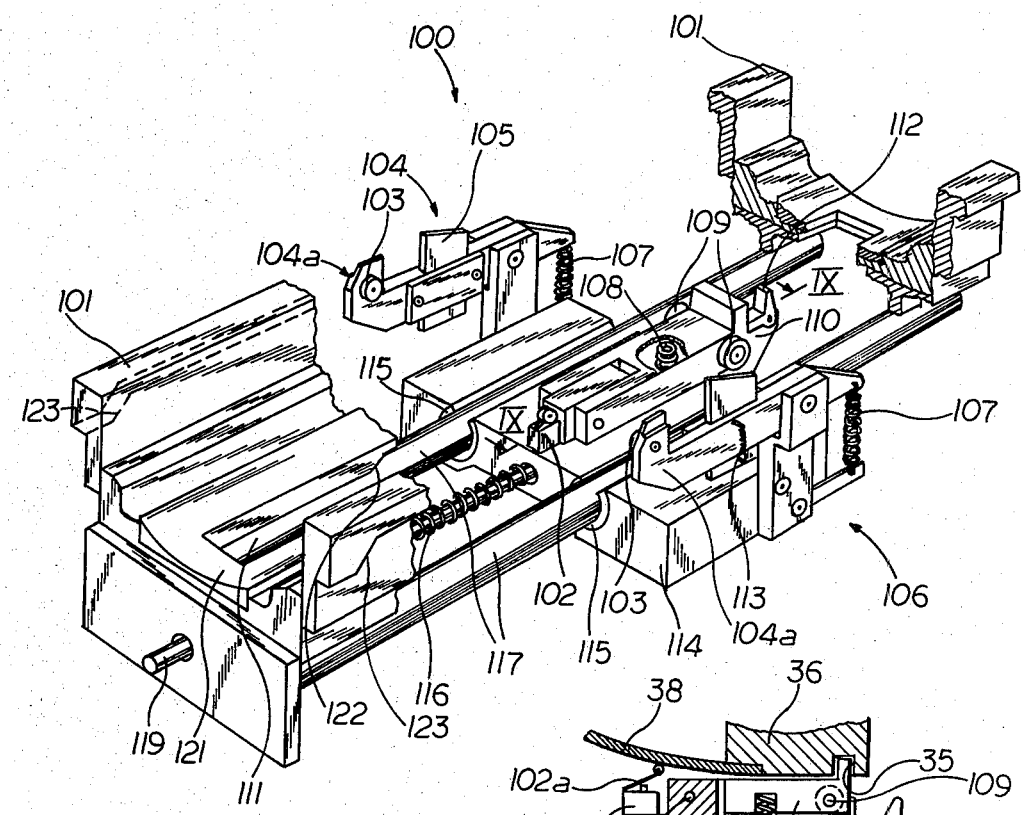
FIG. 8, showing the shell and case separator.

FIG. 8 shows a shell separator 100, which is fixed to the strut 73 and two arms 71 on the cradle 62. FIGS. 4 and 6 show only its outline 74. The arms 71 are fixed to the lower back part of the flanges 60. On the outside of the jacket 50, on each side of the breech, are two wings 83 and 76 (see FIG. 6), with a retractable cam 81 on the wing 83, and another retractable cam 78 on the wing 76. These wings 83 and 76 are attached to be cradle and extend towards the back end of the gun, on the same axis. The cams 78 and 81 are positioned on the wings so that they will connect with two levers 77 and 82 (see FIGS. 14 and 15). The flanges 60 of the cradle 62 also comprise two bearings 61, on which rotates a shaft (not shown here), carrying two chain-drive wheels of a conventional conveyor (not shown here); after simulated firing, this transfers the shell to a storage and shell separator displacement point. In the embodiment illustrated here, these bearings 61 are located in the upper rear part of the flanges 60.

Figure 9:
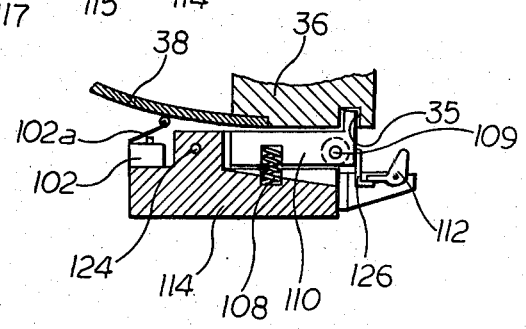
FIG. 9 showing a detail view of the separator forming part of the gun illustrated in FIGS. 3 to 7, in the position in which it is in contact with the shell.

FIGS. 8 and 9 show the shell separator 100, comprising a framework 101 fixed to the cradle 62, and a movable carriage 106. The frame 101 is shown partly cut away, to show the carriage more clearly. The frame is constructed from sections, to form a "U" shape, the bottom 121 corresponding to the shape of the back part of the shell case, which rests on it. The front part of the frame 101 comprises two cam surfaces 123, which halt further movement of the carriage, and the back part comprises two cam surfaces 122 to release the shell. The lower part of the frame comprises guide-rods 117, along which the carriage 106 moves. This carriage mainly comprises a rectangular parallelipiped-shaped base 114, two hook displacement systems 104 on each side of the base, and a shell withdrawal hook 110. The carriage base 114 moves on the guide-rods 117 by means of ball-bearing sockets 115. When at rest, it is pushed towards the back end of the frame, beside the breech jacket 50, by a spring 116, supported by a shank 119, one end of which is fixed to the carriage base, while the other end slides through a frontal plate on the frame.

The shell withdrawal hook pivots on a horizontal axle 124 fixed on the carriage base 114. The hook is held in its raised position by a spring 108, which presses on the base 114. It can be lowered by a retraction lever 112, acting on a brace 126 fixed to the back end of the hook. This lever 112 pivots under pressure from the pin on one end 90 of a flexible drive 91 fixed beneath the breech (see FIG. 7), and operated by a cam 151 on the first mechanism (see FIG. 10). There are two rollers 109 on each side of the withdrawal hook 110, at the back. An electrical contactor 102 on the carriage base 114 supplies a signal to the electronic system of the simulator (not shown here), as soon as a shell is inserted into the breech, as the shell head presses on the contactor sensing device 102*a*. Each of the two shell displacement systems 104 comprises a hook 104*a*, roller 103, retaining bolt 105, and two springs, one of which 107 keeps the hooks raised, while the other 113 keeps the retaining bolts raised. In the embodiment illustrated here, each displacement system 104 is generally F-shaped, the spine of which is supported horizontally by a bracket on the carriage 106, with the possibility of rotation on a horizontal axle fixed to the bracket; the free end of this spine is drawn downwards in the direction of the carriage base 114 by a spring 107. The smaller cross-arm of the F, the bolt 105, takes the form of an approximately oblong plate, which can slide vertically, within limits determined by a device not shown here, through an opening in the spine, and is drawn upwards by a spring 113 on the spine. The other cross-arm of the F is the hook 104*a*, carrying a roller 103, which revolves on a horizontal axis. The shapes of the hook 104*a* and bolt 105 depend on the type of conveyor used.

When shell and case are inserted into the breech 51, the shell-withdrawal hook 110 fits into the groove 35 in the shell, and the contactor 102 emits the signal indicating that the gun is loaded. The electronic system actuates release by the electro-magnetic release system, inside the recess 52, and starts up the conveyor. The displacement pins of two chains of the conveyor system (not shown here) fit between the retaining bolts 105 and hooks 104*a*. The shell is separated from the case, and displaced by the chain conveyor on to the frame bottom 121, containing a rectangular opening 111, which lets the end of the shell-withdrawal hook 110 pass. During displacement of the shell, two pincers on the conveyor chains (not shown here) grip the shell by the shank, by fitting into the grooves 27 and 32. When the rollers 109 pass under the cam surfaces 122, as the carriage base 114 moves forward, they are pushed down, and the shell withdrawal hook descends, releasing the shell. The rollers 103 on the hooks 104 then pass beneath the cam surfaces 103 as the carriage 114 moves forward; the rollers 109 must be pushed down before the rollers 103. When the rollers 103 descend, they lower the hooks 104, and release the carriage, which is moved back by the spring 116 to its rest position. As soon as the shell has left the separator, the conveyor stops, and waits for the next shell.

FIGS. 10 and 11 show the first mechanism, the breech-wedge control mechanism, comprising an axle 143 which revolves on bearings 56*a* on the two supports 56 fixed beneath the breech (see FIG. 4). On this axle, and fixed to it, are a lever 82, outside the bearing 56*a*, with a crank pin on the side facing the wing 83, and connecting with the cam 81, a breech-opening ring 149, containing a radial displacement pin 148; an approximately oval cam-wheel 145, a toothed arc 144 with an angle of approximately 120° at the centre; and a first drum 142, on which a cable 139 is wound. Only the lever 82 is fixed outside the bearings 56*a*. The toothed arc 144 meshes with the breech-wedge rack 67. Also on the axle, able to rotate freely, are a manual control ring 150, on which an opening lever 135 is mounted, and which comprises a first cam 152, extending radially, a displacement pin extending axially, a second cam 151 acting radially, and also a second drum 146, on which a cable 156 is wound, and which comprises a displacement pin 147 extending axially towards the pin 148 and a cam 160 on its circumference (see FIG. 11). The opening lever 135 comprises a retractable pin 158, which retracts when a safety button 136 at the end of the lever is pressed, and which returns to its non-retracted position under the pressure of an inside spring (not shown here), when the button is released. The lever 135 is kept in the raised position, as shown in FIG. 10, by the pin 158, which is in its projecting position, and which fits into a matching hole in a brace 57 fixed to the breech 51. The pin 158 connects with a contactor 137 inside the brace 57, informing the electronic control system that the lever 135 is locked in its raised position. To lower the lever, in the direction of the arrow 135*a*, it is released by pressing the button 136. The displacement pin 155 on the ring 150 causes the pin 148 on the ring 149, and the pin 147 on the drum 146, to rotate when the lever 135 is lowered in the direction of the arrow 135*a*. The breech-wedge control mechanism also comprises two spring boxes 92 fixed to the breech 51, one containing a spring 138, which is compressed by pulling the cable 139, and the other a second spring 159, which is compressed by pulling the cable 156, such traction being obtained by lowering the lever 135; a locking device 157 pivoting on a horizontal axle between two bearings 95 (see FIG. 7), and held downwards, away from the breech, by a spring 141 in a recess 94 (see FIG. 7) in the breech 51; and the aforementioned electrical contactor 137 which sends an electrical signal to a signal light (not shown here), whenever its sensor is not in contact with the pin 158. The first spring 138 is strong enough to enable the breech wedge to be raised by means of the toothed arc 144, and to allow the shell to be fully inserted into the breech by the breech wedge, while the sum of the forces of the first spring 138 and spring 156 is selected so that both of them transmit a combined force of resistance of approximately 70 daN to the opening lever 135, equal to the force actually applied by the gun-loader when he operates this lever. The breech-wedge control mechanism also comprises the first retactable cam 81 on the wing 83 (see FIG. 6).

Figure 12:
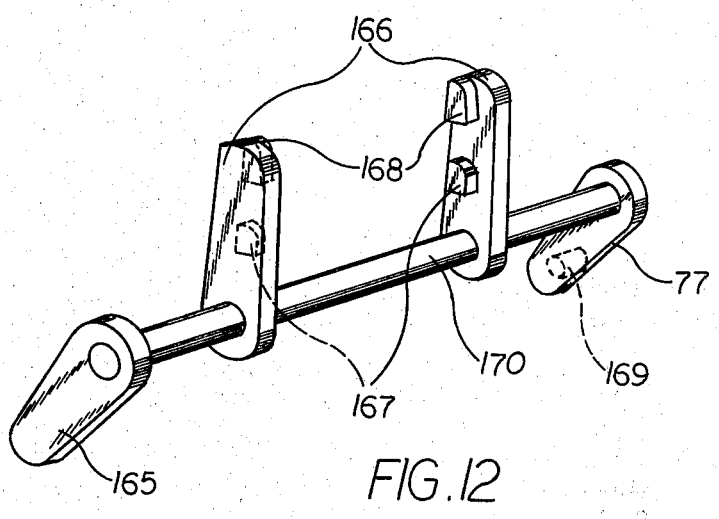
FIG. 12, showing a view in perspective of the extractor control mechanism of the gun illustrated in FIGS. 3 to 7.

FIG. 12 shows the extractor control mechanism, or second mechanism, comprising an axle 170, which rotates horizontally on bearings 66 (see FIG. 4) on the breech; two extractors 166 fitted radially to the shaft, parallel with each other and each containing an ejector lug 168 at the unattached end and, approximately halfway down, a locking pin 167, these four projections facing each other in pairs; and a lever 77 comprising a crank pin 169. The extractors 166 pivot inside recesses 65 in the breech. The extractor control mechanism also comprises the second retractable cam 78 on the wing 76 (see FIG. 6).

To open the breech, the gun-loader lowers the opening lever 135, in the direction shown by the arrow 135*a*. The manual control ring 150 directly rotates the breech-opening ring 149 and the second drum 146. The ring 149 in turns displaces the shaft 143, which rotates the toothed arc 144 and the first drum 142. The toothed arc 144 causes the breech wedge to descend, while the cable 139 compresses the first spring 138. At the same time, rotation of the second drum 146 compresses the second spring 159, and the cam 160 meshes with the locking device 157, which blocks it, thereby releasing the manual control ring 150 from the force applied by the second spring 159. In addition, as the ring 150 rotates, the first cam 152, passes through the opening 93 (see FIG. 7) and meshes with the cam 165 (see FIGS. 12 and 13) and causes the extractors to pivot out of the breech. The pins 167 on these extractors mesh with the catch 64 on the breech wedge and block it in the lowered position (see FIG. 13).

After lowering of the opening lever 135, the force of the second spring 159 is borne by the locking device 157, which blocks rotation of the drum 146 because it is against the cam 160, while the spring 138 is kept compressed, since the first drum 142, toothed arc 144 and breech wedge 53 are immobilized by the extractors 166. For safety reasons, the gun-loader then has to raise the lever 135 to the position in which the pin 158 fits into the slot in the brace 57.

Figure 13:
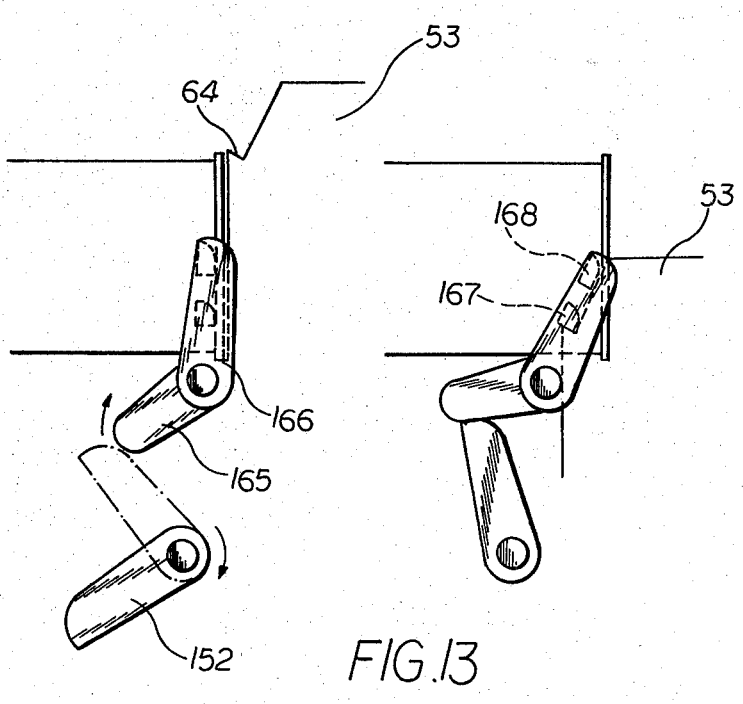
FIG. 13, showing movements performed by the mechanisms and possibly the shell, during manual opening of the gun breech illustrated in FIGS. 3 to 7.

Operation of the two mechanisms during manual opening is illustrated in FIG. 13. The first cam 152 causes pivoting of the cam 165 and the extractors 166, which thereupon lock the breech wedge 53 and cause any shell present in the breech to be ejected.

When ammunition is inserted into the breech, the flange 11*a* on the shell base connects in the conventional way with the pins 167 to move the extractors 166 into the breech, thereby releasing the breech wedge 53, which rises, closing the breech through pressure from the first spring 138, transmitted by the toothed arc 144 The axle 143 (see FIG. 10) also rotates the cam 145, which raises the locking device 157. The second drum 146 is freed, releasing compression on the second spring 159. This release is also obtained by insertion of the first shell. As soon as the shell enters the breech, the contactor 102 (see FIG. 8) indicates its presence to the electronic system, which triggers the electromagnet release mechanism in the breech wedge, thereby freeing the shell from its case. The shell is then separated from the case by the separation system, and removed by the conveyor.

Firing operations by the gunner, using means (not shown here) that reproduce actual tank controls, result in the emission of an electrical signal to the electronic system, resulting in a recoil effect produced by the first jack 72.

Figure 14:
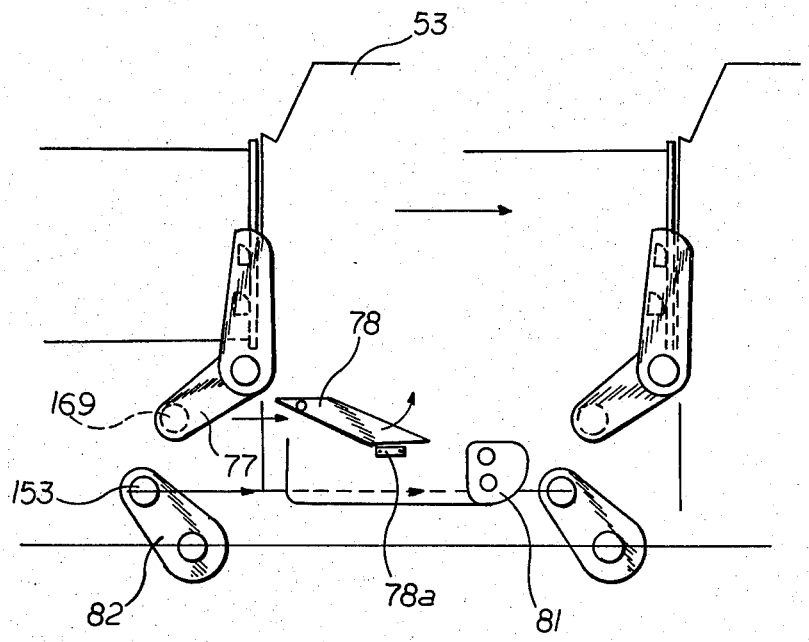
FIGS. 14 and 15, showing movements performed by mechanisms and shell during recoil and return of the breech, respectively.

FIG. 14 shows the relative positions of the mechanisms, and retraction of the cams during the movement of recoil, when the crank pin 169 on the lever 77 raises the cam 78, while the crank pin 153 on the lever 82 causes the first retractable cam 81 to pivot, without meshing with it. Return of the breech is obtained by retraction of the jack 72, immediately following recoil.

Figure 15:
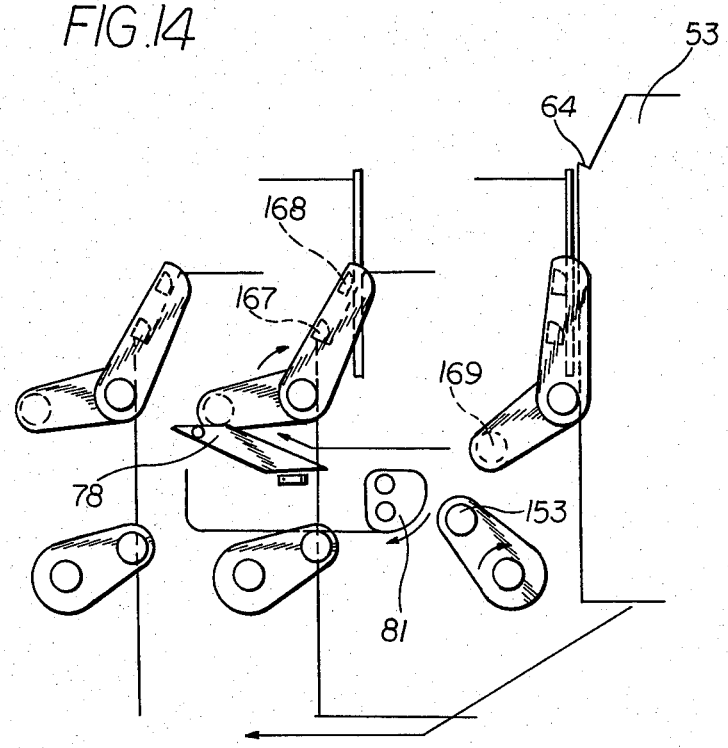

FIG. 15 shows the relative positions of the mechanism, breech wedge and shell during the return movement. The crank pin 153 fits under the first retractable cam 81 and causes rotation of the breech-wedge control mechanism. This makes the breech wedge move downwards, and compresses the first spring 138. The crank pin 169 then fits beneath the second rectactable cam 78, and causes rotation of the extractor mechanism, moving the extractors out of the breech. The lugs 168 cause ejection of the shell-case, while the pins 167 connect with the catch 64 on the breech wedge, and lock it in the lowered position. After return of the breech 51, another shell can be inserted. This causes return of the extractors 166 and release of the breech wedge 53, which rises under the force of the first spring 138.

The breech is opened either to insert ammunition or to remove a "defective" shell during contingency training. Presence of such a shell is programmed by the instructor, and taken into account by the electronic system, which in this particular case does not lock the shell and case when the ammunition is loaded, or actuate the first jack 72 on firing. The gun-loader then has to remove the defective shell from the breech. On manual opening, the second cam 151 on the manual opening ring presses on the pin of the flexible drive 91. Its thrust is transmitted to the lever 112 (shown in FIG. 9), which lowers the shell withdrawal hook 110 by pressing on the brace 126 attached to it. The cam 165, in contact with the first cam 152, also causes the extractors to pivot out of the breech 51, ejecting the shell.

What is claimed is:

1. A tank-gun loading simulator for training purposes, wherein the said simulator comprises:

an ammunition, formed of a shell and a case connected together by a system which can be released by applying pressure to the case at the point where in a real shell the detonator would be placed;

a breech, recoil and return of which are guided by two roller slides, under pressure from a first hydraulic jack;

a breech wedge containing, instead of an actual hammer, an electromagnet release system, which applies thrust to the case;

a primary mechanism mounted on the breech, which raises the breech wedge by means of a first spring, transmitting to the breech-opening lever, through this first spring and a second spring, a force of resistance equal to the force applied by the gun-loader to open the breech, and operating a second mechanism where the breech is opened manually;

said second mechanism making the extractors pivot out of the breech through the effect of the first mechanism and during manual opening of the breech;

a cradle, comprising:

a breech jacket inside which the breech effects its recoil and return movements on roller slides, two flanges supporting the jacket, and separated from each other by a strut on which the first jack presses, bearings pivoting in elevation in these flanges, a second jack pivoting in elevation, fixed to one of the flanges and to the base of the simulator;

and a shell separator mounted on the cradle, which separates the shell and the case, and moves the shell to the position in which it is gripped by a chain conveyor, as soon as the breech wedge has re-ascended after loading of ammunition.

2. A simulator as defined in claim 1, wherein the shell separator comprises:

a frame, fitted to the cradle, extending beyond the breech jacket, and constructed from sections, comprising two shell-release cams, two cams to halt further movement and two guide rods;

a carriage sliding along said guide rods, on each side of the carriage two conveyor displacement hooks, each of which comprises a roller and retaining bolt, these hooks and bolts being kept in the raised position by springs, fitted to the carriage, a shell-withdrawal hook, pivoting on a horizontal axle, kept in the raised position by a spring, and comprising two rollers, a retraction lever, which pivots and lowers the hook by pressing on it, an electrical contactor indicating the presence of a shell, a central shank, one end of which is attached to the carriage, and the other end of which is parallel to the guide-rods, through an opening in the frame, a spring, surrounding the central shank and compressed on it between the carriage and the frame, and wherein:

in the absence of external forces, the carriage is kept in its rest position by pressure from the spring on the central shank;

as soon as ammunition is loaded into the breech, the withdrawal hook fits into a groove on the shell, and the contactor supplies a signal to an electronic system, as soon as the signal indicating the presence of a shell has been received by the electronic system, chain-conveyor pins fit between the displacement hooks and retaining bolts, and displace the carriage toward the release position, displacement of the carriage causes separation of the shell and the case, and moves the shell on the frame to the position in which it is gripped by the conveyor, the withdrawl hook rollers connecting with the shell-release cams and making the withdrawal hook pivot, thereby releasing it from the shell groove, after the withdrawal hook has been released from the shell groove, the diplacement hook rollers connect with the displacement-halting cams and release the carriage, which returns to its original position, under pressure from the spring on the central shank.

3. A simulator as defined in claim 2, wherein the first mechanism comprises:

an axle which revolves on two bearings mounted on the breech, on this axle and fixed to it, a lever with a crank pin, a breech-opening ring containing a displacement pin, a cam, a toothed arc, and a first drum, on the axle and able to rotate freely, a manual control ring, on which the breech-opening lever is mounted, and which comprises a first cam and a second cam, and a displacement pin, a second drum, on which is a displacement pin, fixed to the breech, a first spring box containing a first spring, which is compressed by means of a cable wound on the drum, a second spring box containing a second spring, which is compressed by means of a cable wound on the second drum, a locking device pivoting on an axle fixed to the breech and held away from it by a spring, a flexible drive, a first retractable cam on one of the wings fixed to the cradle, wherein said secondary mechanism comprises a second retractable cam on the other wing fixed to the cradle, and wherein:

when the opening lever is lowered by the gun-loader, the displacement pin on the manual control ring rotates the second drum, the cable on which compresses the second spring, and the breech-opening ring, which rotates the axle to which it is fixed, this axle thereby rotating the toothed arc, which meshes with the rack on the breech wedge, and lowers the said wedge, and the first drum, the cable on which compresses the first spring, the first cam of the manual control ring connecting with the cam on the second mechanism and causing the extractors to pivot out of the breech, and the locking device connecting with the cam on the second drum, and bearing the force of the second spring, which is thus kept compressed, the second cam of the manual control ring pressing on the end of the flexible drive, which simultaneously actuates the shell-separator retraction lever, the extractors blocking the breech wedge on the lowered position, and the toothed arc, which is also blocked, keeping the spring compressed, through the agency of the axle and first drum;

the opening lever being raised, and when ammunition is loaded into the breech, the extractors release the breech wedge, which moves upwards under the combined pressure of the toothed arc, the first drum and the first spring, which is released, the cam fixed to the axle raises the locking device, which releases the second drum, thereby releasing the spring, when the breech returns the crank pin on the lever forming part of the first mechanism connects with the first retractable cam, and by rotating the axle, toothed sector and first drum, thereby lowers the breech wedge and compresses the first spring.

4. A simulator as defined in claim 1 wherein the shell comprises:

a head, a shank, a first means of connection, the head itself comprising a cylindrical barrel, a conical head force-fitted on to the barrel, and a ring-shaped wedge, which fits into a cylindrical axis recess in the barrel, one end of the shank being screwed axially into the barrel, and the other end carrying the first means of connection, the barrel comprising a circular external groove, the wedge ring, comprising an outward-tapering bearing surface, sliding on the shank and inside the barrel recess, and being pushed away from the bottom of this recess by springs, the case comprises a casing, preferably consisting of a real shell case, a shell-shank guide system, and second means of connection, the guide system comprises an opening with an inward-tapering bearing surface, a tube and a supporting base, the base being screwed to the casing-base, the tube being force fitted to the supporting base, and the opening ring being force-fitted on to the tube;

the case also comprises a resilient cast and polymerized plastic lining between the guiding system and the casing;

the second means of connection is positioned on the tube and supporting base axis, and fixed to the case at the point coupled in a real shell by the detonator, the assembly of the shell and the case resulting from the locking of the first and second means of connection is obtained by full insertion of the shank into the case, after locking of the first and second means of connection, the shell and case are connected tightly, by the pressure of the springs, compressed between the wedge ring and the shell barrel, keeping the tapered surface of the ring pressed against the tapered surface of the opening.

5. A simulator as defined in claim 4, wherein:

the first means of connection comprises a tubular retaining end, one end of which is screwed on to the shank, and the other end of which contains a neck, the second means of connection is formed of a locking device which comprises a support, a lock-barrel, a control rod, locking balls, a mask, and two springs.

* * * * *